US011614763B1

(12) United States Patent
Bhatta et al.

(10) Patent No.: US 11,614,763 B1
(45) Date of Patent: Mar. 28, 2023

(54) REFERENCE VOLTAGE GENERATOR BASED ON THRESHOLD VOLTAGE DIFFERENCE OF FIELD EFFECT TRANSISTORS

(71) Applicant: QUALCOMM Incorporated, San Diego, CA (US)

(72) Inventors: Debesh Bhatta, San Diego, CA (US); Sulin Li, San Diego, CA (US); Shitong Zhao, San Diego, CA (US); Hui Wang, Cupertino, CA (US); John Abcarius, San Diego, CA (US)

(73) Assignee: QUALCOMM INCORPORATED, San Diego, CA (US)

( * ) Notice: Subject to any disclaimer, the term of this patent is extended or adjusted under 35 U.S.C. 154(b) by 0 days.

(21) Appl. No.: 17/568,614

(22) Filed: Jan. 4, 2022

(51) Int. Cl.
*G05F 3/26* (2006.01)
*G05F 1/46* (2006.01)

(52) U.S. Cl.
CPC ..... *G05F 3/262* (2013.01); *G05F 1/461* (2013.01); *G05F 1/468* (2013.01)

(58) Field of Classification Search
None
See application file for complete search history.

(56) References Cited

U.S. PATENT DOCUMENTS 7,839,202 B2 * 11/2010 Sengupta ..... G05F 3/30 327/539
8,476,967 B2 * 7/2013 Kobayashi ..... G05F 3/242 327/543
11,392,160 B2 * 7/2022 Gvozdenovic ..... H03F 3/45475

* cited by examiner

*Primary Examiner* — Jeffery S Zweizig
(74) *Attorney, Agent, or Firm* — Loza & Loza, LLP

(57) ABSTRACT

An aspect of the disclosure relates to a reference voltage generator, including: a first field effect transistor (FET) including a first threshold voltage; a second FET including a second threshold voltage different than the first threshold voltage; a gate voltage generator coupled to gates of the first and second FETs; a first current source coupled in series with the first FET between first and second voltage rails; a second current source; and a first resistor coupled in series with the second current source and the second FET between the first and second voltage rails, wherein a reference voltage is generated across the first resistor.

25 Claims, 5 Drawing Sheets

REFERENCE VOLTAGE GENERATOR BASED ON THRESHOLD VOLTAGE DIFFERENCE OF FIELD EFFECT TRANSISTORS

FIELD

Aspects of the present disclosure relate generally to reference voltage generator, and in particular, a reference voltage generator based on threshold voltage difference of field effect transistors (FETs).

BACKGROUND

A reference voltage generator is used in many circuits, such as analog circuits, to provide a reference voltage that is substantially temperature independent over a wide temperature range. In the past, reference voltage generators were primarily designed as a bandgap voltage generator that generates a substantially temperature-independent reference voltage by balancing and combining a proportional to absolute temperature (PTAT) current with a complementary to absolute temperature (CTAT) current to generate a substantially temperature-independent current. The temperature-independent current would then be routed through a resistor to generate the substantially temperature-independent reference voltage. The accuracy of such bandgap reference voltage generator would depend on the balancing of the PTAT and CTAT currents, which may be difficult and complicated to achieve.

SUMMARY

The following presents a simplified summary of one or more implementations in order to provide a basic understanding of such implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

An aspect of the disclosure relates to a reference voltage generator. The reference voltage generator includes a first field effect transistor (FET) including a first threshold voltage; a second FET including a second threshold voltage different than the first threshold voltage; a gate voltage generator coupled to gates of the first and second FETs; a first current source coupled in series with the first FET between first and second voltage rails; a second current source; and a first resistor coupled in series with the second current source and the second FET between the first and second voltage rails, wherein a reference voltage is generated across the first resistor.

Another aspect of the disclosure relates to a method of generating a reference voltage. The method includes generating a first current through a first field effect transistor (FET) including a first threshold voltage; generating a second current through a second FET including a second threshold voltage different than the first threshold voltage; and routing the second current through a first resistor to generate the reference voltage across the first resistor.

Another aspect of the disclosure relates to an method for generating a reference voltage. The apparatus includes means for generating a first current through a first field effect transistor (FET) including a first threshold voltage; means for generating a second current through a second FET including a second threshold voltage different than the first threshold voltage; and means for routing the second current through a first resistor to generate the reference voltage across the first resistor.

Another aspect of the disclosure relates to a wireless communication device. The wireless communication device includes: one or more signal processing cores; at least one antenna; and a transceiver coupled to the one or more signal processing cores and to the at least one antenna, wherein the transceiver includes a reference voltage generator, including: a first field effect transistor (FET) including a first threshold voltage; a second FET including a second threshold voltage different than the first threshold voltage; a gate voltage generator coupled to gates of the first and second FETs; a first current source coupled in series with the first FET between first and second voltage rails; a second current source; and a first resistor coupled in series with the second current source and the second FET between the first and second voltage rails, wherein a reference voltage is generated across the first resistor.

To the accomplishment of the foregoing and related ends, the one or more implementations include the features hereinafter fully described and particularly pointed out in the claims. The following description and the annexed drawings set forth in detail certain illustrative aspects of the one or more implementations. These aspects are indicative, however, of but a few of the various ways in which the principles of various implementations may be employed and the description implementations are intended to include all such aspects and their equivalents.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts.

Reference voltage generators, such as bandgap voltage generators, are used in various circuits to generate a substantially temperature-independent reference voltage across a relatively wide temperature range (e.g., −40 degrees Celsius (° C.) to 120° C.). For example, the temperature-independent reference voltage may be used for biasing or as a reference in operational amplifiers, current sources, analog-to-digital converters (ADCs), digital-to-analog converters (DACs), and other analog or mixed-signal circuits.

Generally, a bandgap voltage generator generates a substantially temperature-independent reference voltage by generating a proportional to absolute temperature (PTAT) current and a complementary to absolute temperature (CTAT) current. The PTAT current has a positive slope with temperature variation, and the CTAT current has a negative slope with temperature variation. The bandgap voltage generator balances and combines the PTAT and CTAT currents to generate a substantially temperature-independent reference current, which is then routed through a resistor to generate the substantially temperature-independent reference voltage across the resistor.

A drawback of bandgap voltage generators is that the accuracy of the temperature-independency of the reference voltage is based on the balancing or matching of the PTAT and CTAT currents. In many cases, this balancing or matching of the PTAT and CTAT currents may be difficult for all process-voltage-temperature (PVT) corners, and often involves complicated circuits to achieve the desired temperature independency for the reference voltage. Such complicated circuits typically occupy significant discrete circuit or integrated circuit (IC) footprint, consumes significant power, and adds to the bill of material (BOM) costs of the discrete circuit or IC.

Figure 1A:
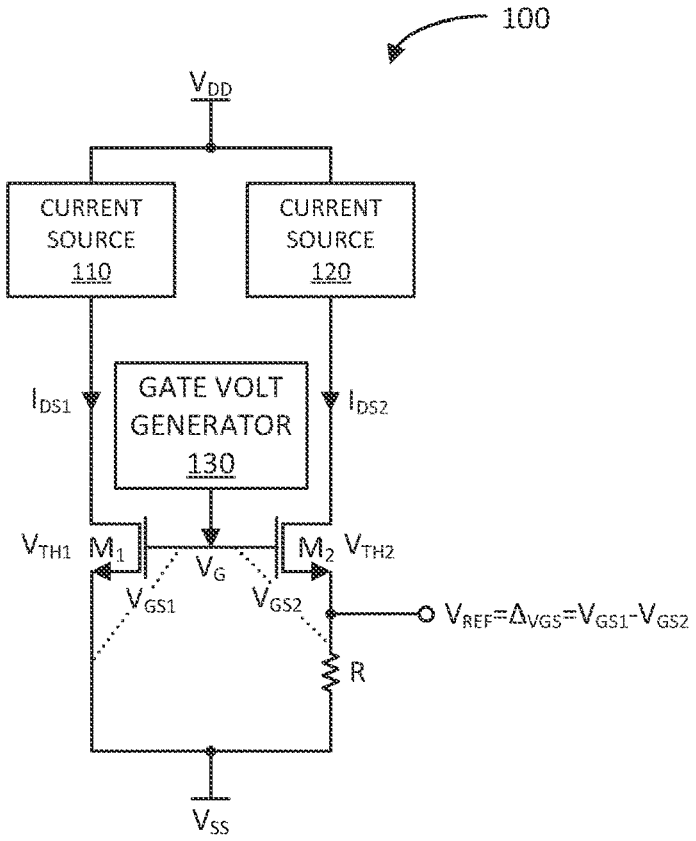
FIG. 1A illustrates a block/schematic diagram of an example reference voltage generator in accordance with an aspect of the disclosure.

FIG. 1A illustrates a block/schematic diagram of an example reference voltage generator 100 in accordance with an aspect of the disclosure. The reference voltage generator 100 may be configured to generate a substantially temperature-independent reference voltage $V_{REF}$ over a relatively wide temperature range (e.g., −40 degrees Celsius (° C.) to 120° C.) without requiring the generation of PTAT and CTAT currents. As discussed in more detail herein, the reference voltage generator 100 relies on metal work function difference to produce field effect transistors (FETs) with different threshold voltages. The difference in metal work functions, and thereby, the difference in threshold voltages of the FETs is substantially temperature independent; and thus, may be used to generate a substantially temperature-independent reference voltage.

In particular, the reference voltage generator 100 includes a first current source 110 and a first field effect transistor $M_1$ coupled in series between an upper voltage rail $V_{DD}$ and a lower voltage rail $V_{SS}$ (e.g., ground). The reference voltage generator 100 further includes a second current source 120, a second FET $M_2$, and a resistor R coupled in series between the upper voltage rail $V_{DD}$ and the lower voltage rail $V_{SS}$. Additionally, the reference voltage generator 100 includes a gate voltage generator 130 configured to generate a gate voltage $V_0$ for the gates of the FETs $M_1$ and $M_2$, which are electrically coupled together. In this example, each of the FETs $M_1$ and $M_2$ may be implemented as an n-channel metal oxide semiconductor (NMOS) FET.

The FETs $M_1$ and $M_2$ may be implemented using different metal work functions to produce different threshold voltages $V_T$ for the devices. The metal work function for a replacement metal gate (RMG) type FET refers to the difference in the Fermi energy and the vacuum level energy associated with the channel of the FET. Or, said differently, the metal work function corresponds to the minimum amount of energy needed to remove an electron from the channel by applying a voltage to the gate. The threshold voltage $V_T$ of a FET is the voltage needed to remove or add electrons to the channel of a FET to achieve channel inversion, and depends on many factors including material composition between the metal gate and the channel, the thickness of the metal, gate-to-channel geometric configuration, and other factors.

For example, FETs may be implemented with a low voltage threshold (LVT) work function, which results in FETs having certain low threshold voltages $V_T$. Whereas, other FETs may be implemented with an ultra-low voltage threshold (ULVT) metal work function, which results in FETs having threshold voltages lower than those implemented with the LVT metal work function. Generally, work function difference is substantially temperature independent. As a consequence, difference in threshold voltages V-r of FETs $M_1$ and $M_2$ is also substantially temperature independent. Using this property, the reference voltage generator 100 is able to generate a reference voltage across the resistor R that is substantially temperature independent.

As discussed, the first and second FETs $M_1$ and $M_2$ are implemented with different work functions to produce different first and second threshold voltages $V_{TH1}$ and $V_{TH2}$, respectively. In this example, the first threshold voltage $V_{TH1}$ is greater than the second threshold voltage $V_{TH2}$. For example, the first FET $M_1$ may have been implemented using an LVT metal work function, and the second FET $M_2$ may have been implemented using an ULVT metal work function. The gate voltage generator 130 may be configured to generate a gate voltage $V_G$ for the FETs $M_1$ and $M_2$ to bias the devices such that they operate in a sub-threshold voltage region, which means that the gate-to-source voltages $V_{GS1}$ and $V_{GS2}$ of the FETs $M_1$ and $M_2$ are substantially equal to their threshold voltages $V_{TH1}$ and $V_{TH2}$, respectively. As the gate-to-source voltages $V_{GS1}$ and $V_{GS2}$ are substantially equal to their respective threshold voltages $V_{TH1}$ and $V_{TH2}$, the difference $\Delta V_{GS}$ in the gate-to-source voltages $V_{GS1}$-$V_{GS2}$ may also be substantially temperature independent over a wide temperature range (e.g., −40 degrees Celsius (° C.) to 120° C.).

Referring again to FIG. 1A, in the reference voltage generator 100, the gate-to-source voltage difference $\Delta V_{GS}$ shows up across the resistor R. For example, the gate-to-source voltage $V_{GS1}$ of FET $M_1$ is between the common gate and $V_{SS}$ or ground (e.g., zero (0) Volt (V)), which also coincides with the lower terminal of the resistor R. The gate-to-source voltage $V_{GS2}$ of FET $M_2$ is between the common gate and the upper terminal of the resistor R. Accordingly, the voltage at the upper terminal of resistor R is $V_G$-$V_{GS2}$, and $V_G$=$V_{GS1}$; thus, the voltage across the resistor R is $V_{GS1}-V_{GS2}-0V=\Delta V_{GS}$.

The current flowing through the resistor R is then $\Delta V_{GS}$/R, where R identifies both the resistor and its resistance. The drain-to-source current $I_{DS2}$ through the FET $M_2$ may be substantially the same as the current through the resistor R. Thus, the drain-to-source current $I_{DS2}$ through the FET $M_2$ is substantially $\Delta V_{GS}$/R, which is substantially the current generated by the second current source 120. As discussed further herein, the first current source 110 may be coupled to the second current source 120 to form a current mirror with a one-to-one (1:1) current ratio so that the drain-to-source current $I_{DS1}$ of the FET $M_1$, is substantially the same as the drain-to-source current $I_{DS2}$ of the FET $M_2$. As discussed further herein, this ensures that the reference voltage $V_1$ is substantially constant over different gate-to-source voltages $V_{GS1}$ and $V_{GS2}$.

Figure 1B:
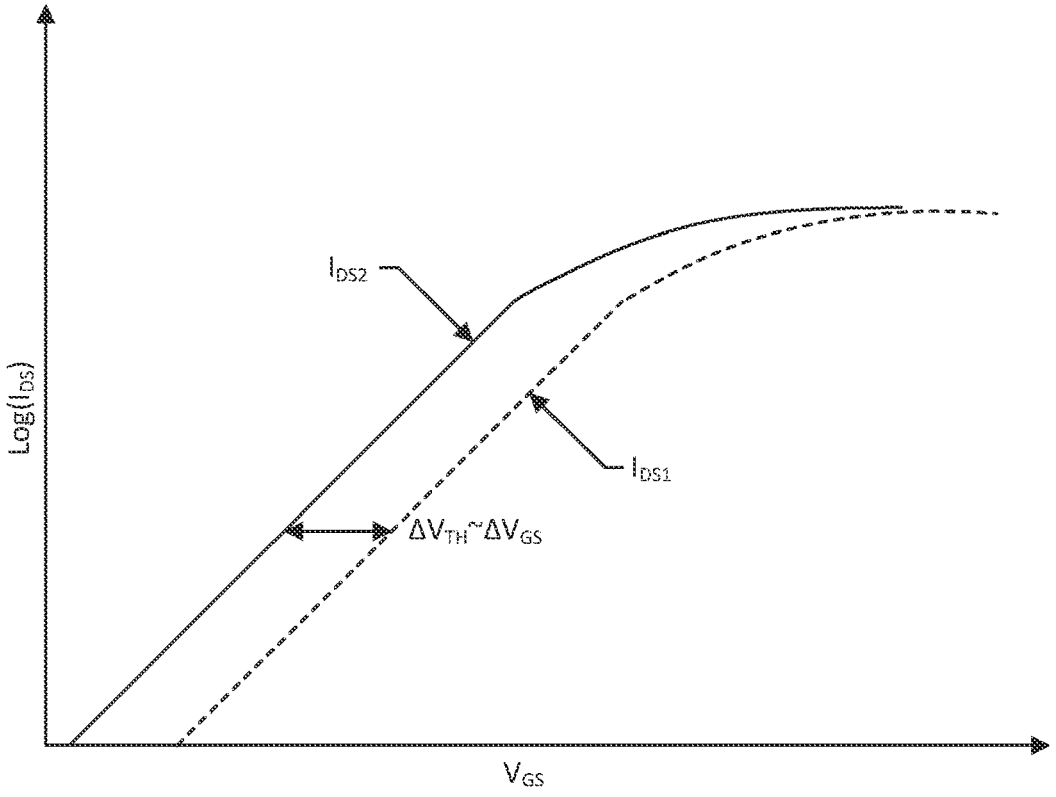
FIG. 1B illustrates a graph depicting example drain-to-source current ($I_{DS}$) to gate-to-source voltage ($V_{GS}$) responses for a pair of field effect transistors (FETs) in the reference voltage generator of FIG. 1B in accordance with another aspect of the disclosure.

FIG. 1B illustrates a graph depicting example drain-to-source current ($I_{DS}$) to gate-to-source voltage ($V_{GS}$) responses for FETs $M_1$ and $M_2$ of the reference voltage generator 100 in accordance with another aspect of the disclosure. The horizontal axis of the graph represents the gate-to-source voltage $V_{GS}$ for the FETs $M_1$ and $M_2$, and the vertical axis represents the logarithm of the drain-to-source currents $I_{DS1}$ and $I_{DS2}$ of the FETs $M_1$ and $M_2$, respectively.

As discussed, due to a metal work function difference associated with the FETs $M_1$ and $M_2$, the FETs $M_1$ and $M_2$ have different threshold voltages $V_{TH1}$ and $V_{TH2}$, respectively. Also, as discussed, the FETs $M_1$ and $M_2$ may have been biased to operate in the sub-threshold region. Accordingly, their gate-to-source voltages $V_{GS1}$ and $V_{GS2}$ are substantially equal to their threshold voltages $V_{TH1}$ and $V_{TH2}$, respectively. Because of the threshold voltage difference $\Delta V_{TH}$, the gate-to-source voltage difference $\Delta V_{GS}$ may produce substantially the same drain-to-source currents $I_{DS1}$ and $I_{DS2}$ through the FETs $M_1$ and $M_2$ if the current sources 110 and 120 are configured to generate substantially equal currents.

The graph depicts the relationship between the drain-to-source current $I_{DS1}$ and the gate-to-source voltage $V_{GS1}$ of the FET $M_1$ as a dash line. The graph depicts the relationship between the drain-to-source current $I_{DS2}$ and the gate-to-source voltage $V_{DS2}$ of the FET $M_2$ as a solid line. Note that the slopes of the $I_{DS1}/V_{GS1}$ and $I_{DS2}/V_{GS2}$ are substantially the same through a large range of $V_{GS}$. However, due to their work function or threshold voltage difference, the $I_{DS2}/V_{GS2}$ response is less or offset from the $I_{DS1}/V_{GS1}$ response by the threshold voltage difference $\Delta V_{TH}$ ($V_{TH1}>V_{TH2}$) or their gate-to-source voltage difference $\Delta V_{GS}$ ($V_{GS1}>V_{GS2}$) that produce substantially the same current density through FETs $M_1$ and $M_2$. These may be conditions that make $\Delta V_{GS}$ substantially independent of temperature over a relatively large temperature range (e.g., −40 degrees Celsius (° C.) to 120° C.).

Figure 2A:
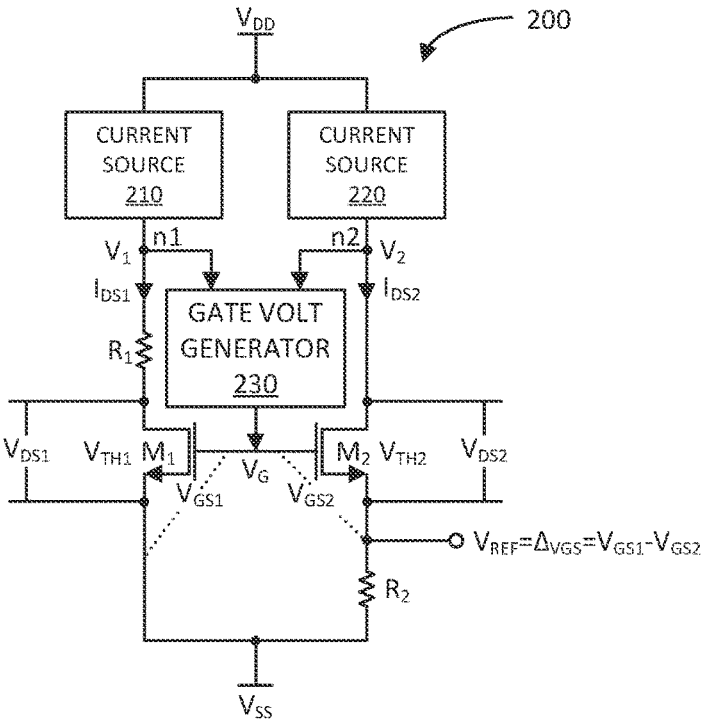
FIG. 2A illustrates a block/schematic diagram of another example reference voltage generator in accordance with another aspect of the disclosure.

FIG. 2A illustrates a block/schematic diagram of another example reference voltage generator 200 in accordance with another aspect of the disclosure. The reference voltage generator 200 is similar to the reference voltage generator 100 but includes a gate voltage generator configured to substantially equalize the drain-to-source voltages $V_{DS1}$ and $V_{DS2}$ of the FETs $M_1$ and $M_2$ under certain conditions, as discussed further herein. Thus, having the same current density ($I_{DS1}$=$I_{DS2}$) in and the same voltage ($V_{DS1}$=$V_{DS2}$) across the FETs $M_1$ and $M_2$ ensures that the reference voltage generated across a resistor $R_2$ is substantially temperature independent. However, the reference voltage generator 200 also provides for setting different current density ($I_{DS1}\neq I_{DS2}$) in and different voltages ($V_{DS1}\neq V_{DS2}$) across the FETs $M_1$ and $M_2$ to cause the reference voltage generated across the resistor $R_2$ to have a certain positive or negative slope with temperature.

More specifically, the reference voltage generator 200 includes a first current source 210, a first resistor $R_1$, and a first FET $M_1$ coupled in series between an upper voltage rail $V_{DD}$ and a lower voltage rail $V_{SS}$ (e.g., ground). The reference voltage generator 200 further includes a second current source 220, a second FET $M_2$, and a second resistor $R_2$ coupled in series between the upper voltage rail $V_{DD}$ and the lower voltage rail $V_{SS}$. Additionally, the reference voltage generator 200 includes a gate voltage generator 230 including a first input coupled to a first node n1 situated between the first current source 210 and the first resistor $R_1$, a second input coupled to a second node n2 situated between the second current source 220 and the second FET $M_2$, and an output coupled to the gates of the FETs $M_1$ and $M_2$.

As mentioned above, the reference voltage generator 200 may be configured to generate a reference voltage $V_{REF}$ that is substantially temperature independent over a relatively wide temperature range. The conditions to achieve the substantially temperature-independent reference voltage $V_{REF}$ may include that the first and second FETs $M_1$ and $M_2$ have different threshold voltages $V_{TH1}$ and $V_{TH2}$ due to different metal work functions, the current density in the FETs $M_1$ and $M_2$ are substantially the same ($I_{DS1}$=$I_{DS2}$), and the voltages across the FETs $M_1$ and $M_2$ are substantially the same ($V_{DS1}$=$V_{DS2}$).

To achieve these conditions, the current sources 210 and 220 are configured to generate substantially the same currents ($I_{DS1}$=$I_{DS2}$) (e.g., by the current sources 210 and 220 being coupled together to form a current mirror with a one-to-one current ratio). The gate voltage generator 230 may be configured to generate a gate voltage $V_G$ to cause the voltages $V_1$ and $V_2$ at respective nodes n1 and n2 to be substantially equal to each other, and the resistances of the resistors $R_1$ and $R_2$ to be substantially the same. This ensures that the voltages across the FETs $M_1$ and $M_2$ are substantially the same ($V_{DS1}$=$V_{DS2}$). For instance, the voltage $V_{DS1}$ is equal to $V_1-I_{DS1}*R_1$, and the voltage $V_{GS2}$ is equal to $V_2-I_{DS2}*R_2$. As $I_{DS1}$=$I_{DS2}$ and $R_1$=$R_2$, then $V_{DS1}$=$V_{DS2}$.

As discussed, the reference voltage generator 200 may also be configured to generate a reference voltage $V_{REF}$ with a certain positive or negative slope with temperature variation. The conditions to achieve this may include non-equal current densities ($I_{DS1}\cdot I_{DS2}$) in and non-equal voltages ($V_{DS1}/\cdot V_{DS2}$) across the FETs $M_1$ and $M_2$. For example, the current sources 210 and 220 may be coupled together to form a current mirror with a current ratio being different than one (1) to produce different current densities ($I_{DS1}\neq I_{DS2}$) in the FETs $M_1$ and $M_2$. Alternatively, or in addition to, the resistance of resistor $R_1$ may be different than the resistance of resistor $R_2$ to produce different voltages ($V_{DS1}\neq V_{DS2}$) across the FETs $M_1$ and $M_2$. This is further explained with reference to the following reference to a graph.

Figure 2B:
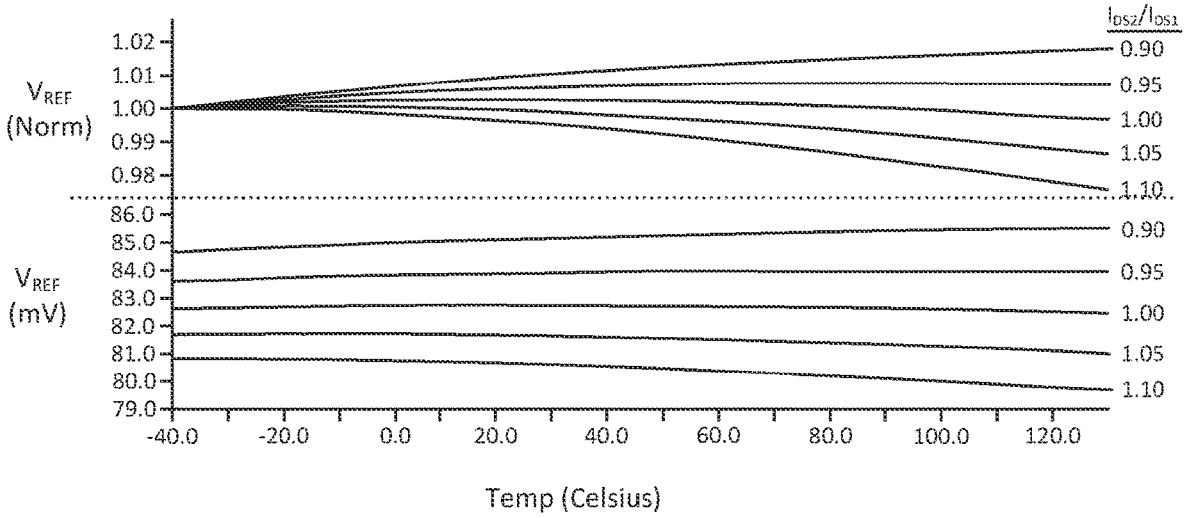
FIG. 2B illustrates a graph depicting example absolute and normalized reference voltage ($V_{REF}$) to gate-to-source voltage ($V_{GS}$) responses associated with the reference voltage generator of FIG. 2B in accordance with another aspect of the disclosure.

FIG. 2B illustrates a graph depicting example absolute and normalized of the reference voltage $V_{REF}$ to temperature responses associated with the reference voltage generator 200 in accordance with another aspect of the disclosure. The horizontal axis of the graph represents temperature extending from −40° C. to −120° C. A lower portion of the vertical axis represents the reference voltage $V_{REF}$ in milliVolts (mV) extending from 79 mV to 86 mV. An upper portion of the vertical axis represents the reference voltage $V_{REF}$ normalized to −40° C. extending from 0.98 to 1.02.

The graph shows five (5) reference voltage $V_{REF}$ to temperature responses based on different current ratios $I_{DS2}/I_{DS1}$ of the drain-to-source currents $I_{DS1}$ and $I_{DS2}$ of the FETs $M_1$ and $M_2$, respectively. As previously discussed, the current sources 210 and 220 may be configured to generate substantially the same currents $I_{DS1}$ and $I_{DS2}$ (e.g., the current sources 210 and 220 are coupled together to form a current mirror with a one-to-one current ratio). Alternatively, the current sources 210 and 220 may be configured to generate substantially different currents $I_{DS1}$ and $I_{DS2}$ (e.g., the current sources 210 and 220 are coupled together to form a current mirror with a current ratio not equal to one (1)). In this example, the five different current ratios $I_{DS2}/I_{DS1}$ are 0.90, 0.95, 1.00, 1.05, and 1.10, identified in the right section of the upper and lower portions of the graph, respectively.

As the graph illustrates, the reference voltage $V_{REF}$ to temperature response for current ratio $I_{DS2}/I_{DS1}$=1.00 is the flattest over the temperature range −40° C. to −120° C. The reference voltage $V_{REF}$ to temperature responses for current ratios $I_{DS2}/I_{DS1}$=0.95 and 0.90 have generally increasing positive slopes over the temperature range −40° C. to −120° C. The reference voltage $V_{REF}$ to temperature responses for current ratios $I_{DS2}/I_{DS1}$=1.05 and 1.10 has generally decreasing negative slopes over the temperature range −40° C. to −120° C. Thus, by setting the current ratio $I_{DS2}/I_{DS1}$ of the currents $I_{DS1}$ and $I_{DS2}$ generated by the current sources 210 and 220, different slopes with temperature variations for the reference voltage $V_{REF}$ may be achieved. For example, the reference voltage $V_{REF}$ response with temperature may be estimated in accordance with the following equation:

$$V_{REF} = \Delta V_{TH} - \left(\frac{kT}{q}\right)\mathrm{LOG}\left(\frac{I_{DS2}}{I_{DS1}}\right) \quad \text{Eq. 1}$$

Where k is Boltzmann's constant, T is temperature, q is the electronic charge in coulomb, $I_{DS1}$ is the current-to-source current of FET $M_1$, and $I_{DS2}$ is the current-to-source current of FET $M_2$.

Figure 3:
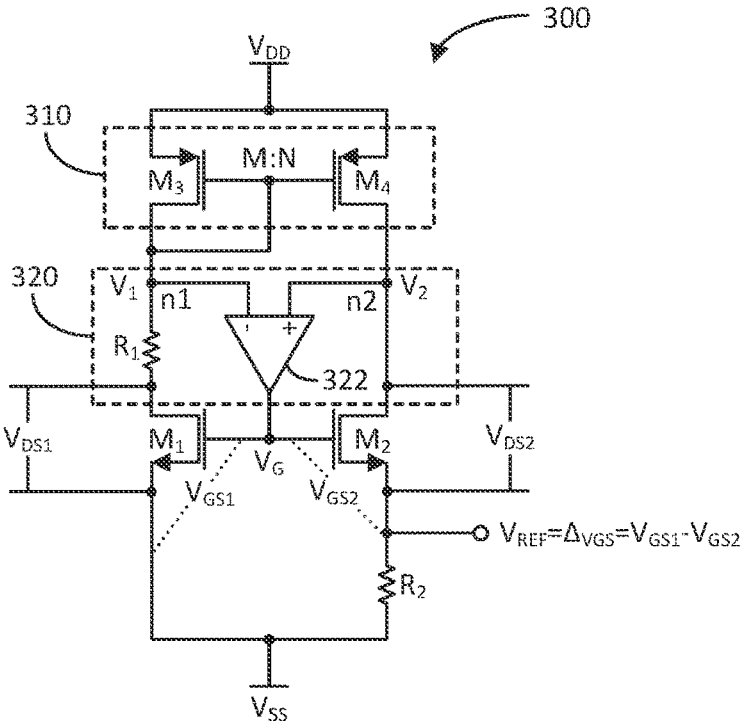
FIG. 3 illustrates a block/schematic diagram of another example reference voltage generator in accordance with another aspect of the disclosure.

FIG. 3 illustrates a block/schematic diagram of another example reference voltage generator 300 in accordance with another aspect of the disclosure. The reference voltage generator 300 may be an example implementation of the reference voltage generator 100 or 200.

In particular, the reference voltage generator 300 includes a current mirror 310 including third and fourth FETs $M_3$ and $M_4$, a gate voltage generator 320 including a first resistor $R_1$ and an operational amplifier 322, FETs $M_1$ and $M_2$, and second resistor $R_2$. The third FET $M_3$, the first resistor $R_1$, and the first FET $M_1$ are coupled in series between an upper voltage rail $V_{DD}$ and a lower voltage rail $V_{SS}$ (e.g., ground). The fourth FET $M_4$, the second FET $M_2$, and the second resistor $R_2$ are coupled in series between the upper voltage rail $V_{DD}$ and the lower voltage rail $V_{SS}$ (e.g., ground). Each of the FETs $M_3$ and $M_4$ may be implemented as a p-channel metal oxide semiconductor (PMOS) FET. As previously discussed, each of the FETs $M_1$ and $M_2$ may be implemented as an NMOS FET. Also, as discussed, the FETs $M_1$ and $M_2$ may be implemented with different metal work functions to produce different threshold voltages $V_{TH1}$ and $V_{TH2}$, respectively.

With regard to the current mirror 310, the third and fourth FETs $M_3$ and $M_4$ may correspond to current sources 110/210 and 120/220 of the reference voltage generator 100/200 previously discussed. The gates of the third and fourth FETs $M_3$ and $M_4$ are coupled together, and to the drain of the third FET $M_3$ to form a current mirror. The FETs M and $M_4$ may be sized, for example, by configuring the ratio (W/L) of the channel width W and channel length L of the FETs $M_3$ and $M_4$ to achieve a desired current ratio ($I_{DS2}/I_{DS1}$). For example, the $W_3/L_3$ of the FET $M_3$ may be sized compared to the $W_4/L_4$ of the FET $M_4$ to achieve a current ratio of M/N or M:N.

With regard to the gate voltage generator 320, the operational amplifier 322 includes a first input (e.g., a negative input) coupled to a first node n1 situated between the third FET $M_3$ and the first resistor $R_1$. The operational amplifier 322 includes a second input (e.g., a positive input) coupled to a second node n2 situated between the fourth FET $M_4$ and the second FET $M_2$. The operational amplifier 322 includes an output coupled to the gates of FETs $M_1$ and $M_2$. The operational amplifier 322 is configured to generate a gate voltage $V_G$ to substantially equalize voltages $V_1$ and $V_2$ at nodes n1 and n2, respectively. Thus, the cumulative voltage drop across the first resistor $R_1$ and first FET $M_1$ is substantially the same as the cumulative voltage drop across the second FET $M_2$ and the second FET $R_2$.

The reference voltage $V_{REF}$ is generated across the second resistor $R_2$, which is equal to the difference $\Delta V_{GS}$ in the gate-to-source voltages $V_{GS1}$ and $V_{GS2}$ of the first and second FETs $M_1$ and $M_2$, respectively. As previously discussed, the reference voltage $V_{REF}$ may be made substantially temperature independent by generating substantially the same current density ($I_{DS1}$=$I_{DS2}$) in and the same voltage ($V_{DS1}$=$V_{DS2}$) across the FETs $M_1$ and $M_2$. This may be accomplished by setting the current ratio M/N of the current mirror 310 to substantially one (1), and setting the resistances of the first and second resistors $R_1$ and $R_2$ substantially equal to each other. If a certain temperature variation for the reference voltage $V_{REF}$ is desired (e.g., as per Eq. 1), the current mirror 310 may be configured with a current ratio not being equal to one (1) (e.g., M/N·1) to produce different current density ($I_{DS1}$·$I_{DS2}$) in the first and second FETs $M_1$ and $M_2$, and/or the resistances of the first and second resistor $R_1$ and $R_2$ not being equal to each other to produce different drain-to-source voltages $V_{DS1}$ and $V_{DS2}$ across the first and second FETs $M_1$ and $M_2$.

Figure 4:
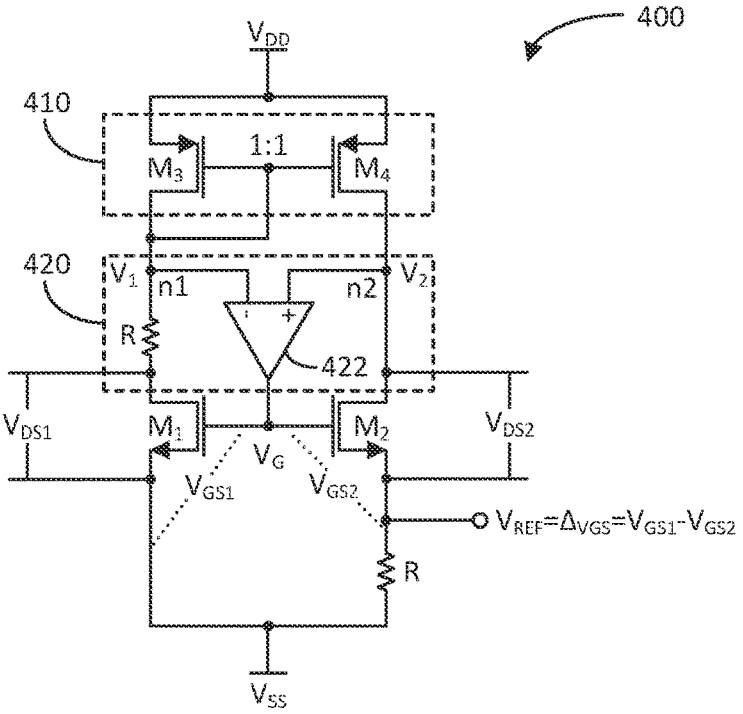
FIG. 4 illustrates a block/schematic diagram of another example reference voltage generator in accordance with another aspect of the disclosure.

FIG. 4 illustrates a block/schematic diagram of another example reference voltage generator 400 in accordance with another aspect of the disclosure. The reference voltage generator 400 is the special case of reference voltage generator 300 where the current ratio M/N of a corresponding current mirror 410 is substantially equal to one (1), and the resistance of the corresponding first and second resistors $R_1$ and $R_2$ is equal, as indicated by identifying these resistors as simply R. As previously discussed, in this configuration, the reference voltage $V_{REF}$ may be substantially temperature independent over a wide temperature range (e.g., −40 degrees Celsius (° C.) to 120° C.) by the current mirror 410 generating substantially the same current density ($I_{DS1}$=$I_{DS2}$) and the gate voltage generator 420 producing the same drain-to-source voltage ($V_{DS1}$=$V_{DS2}$) with respect to the FETs $M_1$ and $M_2$.

Figure 5:
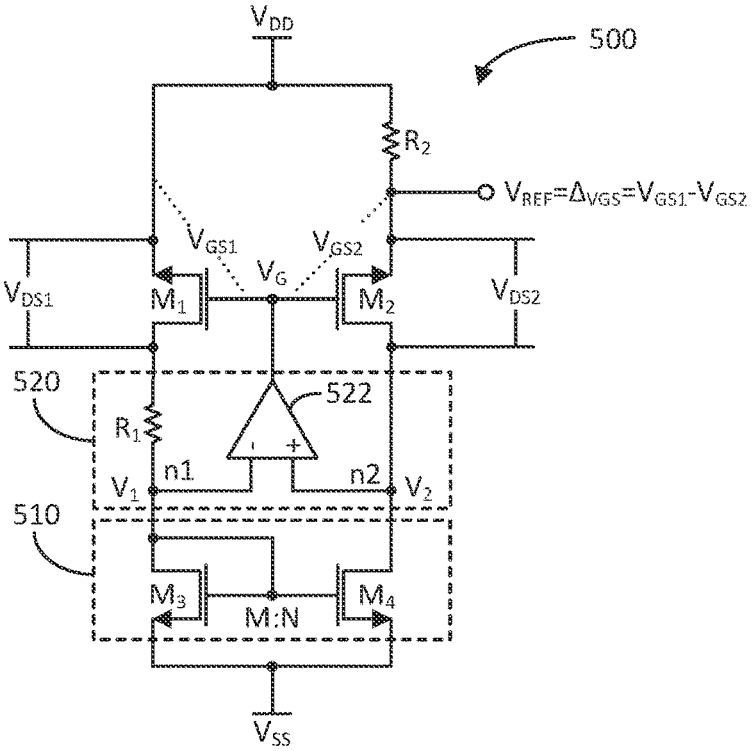
FIG. 5 illustrates a block/schematic diagram of another example reference voltage generator in accordance with another aspect of the disclosure.

FIG. 5 illustrates a block/schematic diagram of another example reference voltage generator 500 in accordance with another aspect of the disclosure. The reference voltage generator 500 may be an example inverted version of the reference voltage generator 300. The inverted version means that the first and second FETs $M_1$ and $M_2$ are PMOS FETs instead of NMOS FETs, the FETs M; and $M_4$ of the corresponding current mirror are NMOS FETs instead of PMOS FETs, and the positions of the components are flipped with respect to the upper and lower voltage rails $V_{DD}$ and $V_{SS}$.

In particular, the reference voltage generator 500 includes a second resistor $R_2$, first and second FETs $M_1$ and $M_2$, a gate voltage generator 520, and a current mirror 510. The current mirror 510, in turn, includes third and fourth FETs $M_3$ and $M_4$; and the gate voltage generator 520, in turn, includes a first resistor $R_1$ and an operational amplifier 522. The first FET $M_1$, the first resistor $R_1$, and the third FET $M_3$ are coupled in series between an upper voltage rail $V_{DD}$ and a lower voltage rail $V_{SS}$ (e.g., ground). The second resistor $R_2$, the second FET $M_2$, the fourth FET $M_4$ are coupled in series between the upper voltage rail $V_{DD}$ and the lower voltage rail $V_{SS}$ (e.g., ground). Each of the FETs $M_1$ and $M_2$ may be implemented as a PMOS FET. Each of the FETs $M_3$ and $M_4$ may be implemented as a NMOS FET. Also, as discussed, the FETs $M_1$ and $M_2$ may be implemented with different metal work functions to produce different threshold voltages $V_{TH1}$ and $V_{TH2}$, respectively.

With regard to the current mirror 510, the third and fourth FETs $M_3$ and $M_4$ may correspond to current sources 110/210 and 120/220 of the reference voltage generators 100/200 previously discussed; although in this configuration, the FETs $M_3$ and $M_4$ may also be referred to as current sinks. The gates of the third and fourth FETs $M_3$ and $M_4$ are coupled together, and to the drain of the third FET $M_3$ to form a current mirror. The FETs $M_3$ and $M_4$ may be sized, for example, by configuring the channel width to length ratio W/L of the FETs $M_3$ and $M_4$ to achieve a desired current ratio ($I_{DS2}/I_{DS1}$). For example, the $W_3/L_3$ of the FET $M_3$ may be sized compared to the $W_4/L_4$ of the FET $M_4$ to achieve a current ratio of M/N or M:N.

With regard to the gate voltage generator 520, the operational amplifier 522 includes a first input (e.g., a negative input) coupled to a first node n1 situated between the first resistor $R_1$ and the third FET $M_3$. The operational amplifier 522 includes a second input (e.g., a positive input) coupled to a second node n2 situated between the second FET $M_2$ and the fourth FET $M_4$. The operational amplifier 522 includes an output coupled to the gates of FETs $M_1$ and $M_2$. The operational amplifier 522 is configured to generate a gate voltage $V_G$ to substantially equalize the voltages $V_1$ and $V_2$ at nodes n1 and n2, respectively. Thus, the cumulative voltage drop across the first FET $M_1$ and the first resistor $R_1$ is substantially the same as the cumulative voltage drop across the second resistor $R_2$ and the second FET $M_2$.

Figure 6:
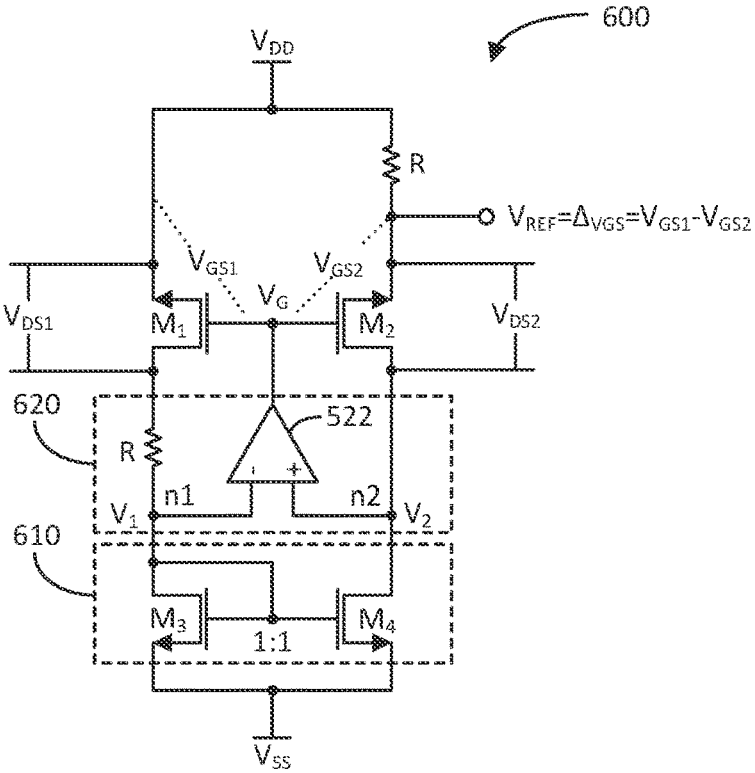
FIG. 6 illustrates a block/schematic diagram of another example reference voltage generator in accordance with another aspect of the disclosure.

The reference voltage $V_{REF}$ is generated across the second resistor $R_2$, which is equal to the difference $\Delta V_{GS}$ in the gate-to-source voltages $V_{GS1}$ and $V_{GS2}$ of the first and second FETs $M_1$ and $M_2$, respectively. As previously discussed, the reference voltage $V_{REF}$ may be made substantially temperature independent by generating substantially the same current density ($I_{DS1}=I_{DS2}$) in and the same voltage ($V_{DS1}=V_{DS2}$) across the FETs $M_1$ and $M_2$. This may be accomplished by setting the current ratio M/N of the current mirror 510 to substantially one (1), and setting the resistances of the first and second resistors $R_1$ and $R_2$ substantially equal to each other. If a certain temperature variation for the reference voltage $V_{REF}$ is desired (e.g., as per Eq. 1), the current mirror 510 may be configured with a current ratio not being equal to one (1) (e.g., $M/N \neq 1$) to produce different current density ($I_{DS1} \neq I_{DS2}$) in the first and second FETs $M_1$ and $M_2$, and/or the resistances of the first and second resistor $R_1$ and $R_2$ not being equal to produce different drain-to-source voltages $V_{DS1}$ and $V_{DS2}$ across the first and second FETs $M_1$ and $M_2$, respectively FIG. 6 illustrates a block/schematic diagram of another example reference voltage generator 600 in accordance with another aspect of the disclosure. The reference voltage generator 600 is the special case of reference voltage generator 500 where the current ratio M/N of a corresponding current mirror 610 is substantially equal to one (1), and the resistance of the corresponding first and second resistors $R_1$ and $R_2$ is equal, as indicated by identifying these resistors as simply R. As previously discussed, in this configuration, the reference voltage $V_{REF}$ may be substantially temperature independent over a wide temperature range (e.g., −40 degrees Celsius (° C.) to 120° C.) by the current mirror 610 generating substantially the same current density ($I_{DS1}=I_{DS2}$) and the gate voltage generator 620 producing the same drain-to-source voltage ($V_{DS1}=V_{DS2}$) with respect to the FETs $M_1$ and $M_2$.

Figure 7:
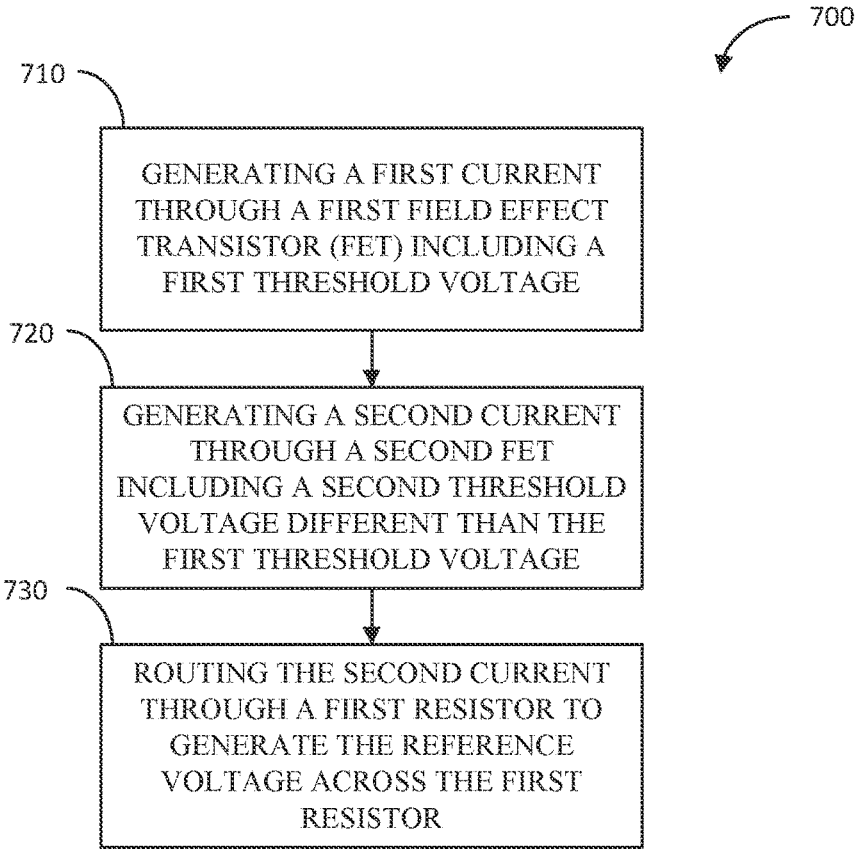
FIG. 7 illustrates a flow diagram of an example method of generating a reference voltage in accordance with another aspect of the disclosure.

FIG. 7 illustrates a flow diagram of an example method 700 of generating a reference voltage $V_{REF}$ in accordance with another aspect of the disclosure. The method 700 includes generating a first current through a first field effect transistor (FET) including a first threshold voltage (block 710). Examples of means for generating a first current through a first field effect transistor (FET) including a first threshold voltage include current sources 110, 210, and FETs $M_3$.

The method 700 further includes generating a second current through a second FET including a second threshold voltage different than the first threshold voltage (block 720).

Examples of means for generating a second current through a second FET including a second threshold voltage different than the first threshold voltage include current sources 120, 220, and FET $M_4$.

Additionally, the method 700 includes routing the second current through a first resistor to generate the reference voltage across the first resistor (block 730). Examples of means for routing the second current through a first resistor to generate the reference voltage across the first resistor include the series coupling of the FET $M_2$ and the resistor $R_2$.

The method 700 may further include biasing the first FET with a first drain-to-source voltage; and biasing the second FET with a second drain-to-source voltage, wherein the first drain-to-source voltage is substantially equal to the second drain-to-source voltage.

Examples of means for biasing the first and second FETs include the gate voltage generators 130 and 230, gate voltage generator 320 including operational amplifier 322 and associated resistor $R_1$, gate voltage generator 420 including operational amplifier 422 and associated resistor R, gate voltage generator 520 including operational amplifier 522 and associated resistor $R_1$, and gate voltage generator 620 including operational amplifier 622 and associated resistor R.

Figure 8:
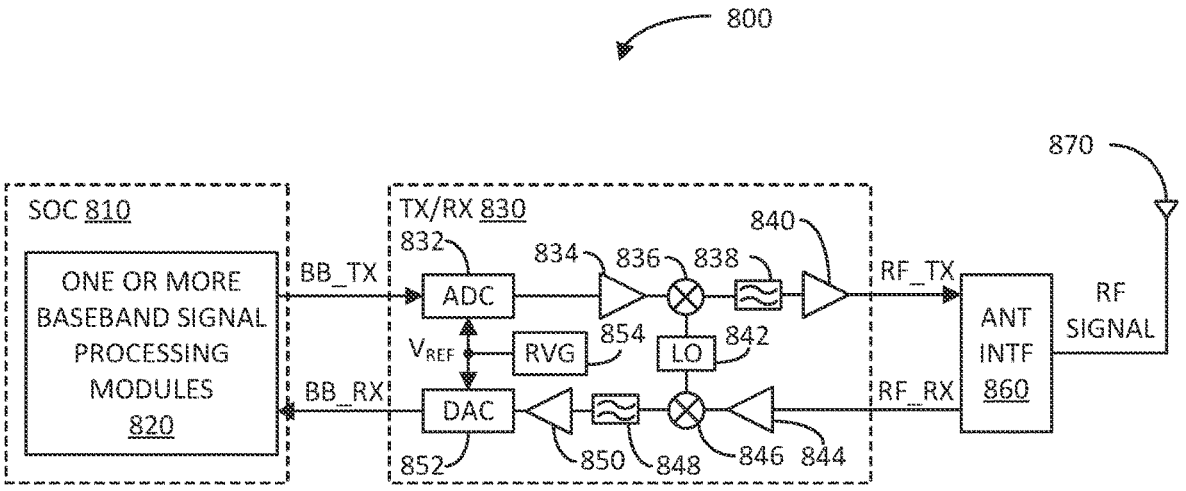
FIG. 8 illustrates a block diagram of an example wireless communication device in accordance with another aspect of the disclosure.

FIG. 8 illustrates a block diagram of an example wireless communication device 800 in accordance with another aspect of the disclosure. The wireless communication device 800 includes an integrated circuit (IC) 810, which may be implemented as a system on chip (SOC). The SOC 810 includes one or more baseband signal processing modules 820.

The wireless communication device 800 further includes a transceiver (Tx/Rx) 830 coupled to the one or more baseband signal processing modules 820 to receive a digital baseband transmit signal BB_TX therefrom, and provide a digital baseband receive signal BB_RX thereto. The transceiver (Tx/Rx) 830 may include an analog-to-digital converter (ADC) 832, a baseband amplifier 834, an up-converting mixer 836, a radio frequency (RF) filter 838, and a power amplifier 840. These devices 832, 834, 836, 838, and 840 cascaded together, with the mixer 836 coupled to a local oscillator (LO) 842, are configured to convert the digital baseband transmit signal BB_TX into an RF transmit signal RF_TX. The transceiver (Tx/Rx) 830 further includes a low noise amplifier (LNA) 844, a down-converting mixer 846, a baseband filter 848, a baseband amplifier 850, and a digital-to-analog converter (DAC) 852. These devices 844, 846, 848, 850, and 852 cascaded together, with the mixer 846 coupled to the local oscillator (LO) 842, are configured to convert an RF received signal RF_RX into the digital baseband received signal BB_RX.

The transceiver 830 may further include a reference voltage generator (RVG) 854 configured to generate a reference voltage $V_{REF}$. The reference voltage generator 854 may be implemented per any of the reference voltage generators 100, 200, 300, 400, 500, and 600 previously discussed. The RVG 854 is coupled to the ADC 832 and the DAC 852 to provide the reference voltage $V_{REF}$ thereto. The ADC 832 converts the digital baseband transmit signal BB_TX into an analog baseband transmit signal based on the reference voltage $V_{REF}$. Similarly, the DAC 852 converts the analog received baseband signal from the baseband amplifier 850 into the digital baseband transmit signal BB_RX based on the reference voltage $V_{REF}$.

The wireless communication device 800 further includes an antenna interface 860 and at least one antenna 870. The transceiver 830 is coupled to the at least one antenna 870 via the antenna interface 860. The antenna interface 860 is configured to route the RF transmit signal RF_TX to the at least one antenna 870 for wireless transmission thereof. The antenna interface 860 is also configured to route the RF received signal RF_RX wirelessly received via the at least one antenna 870 to the transceiver 830.

The following provides an overview of aspects of the present disclosure:

Aspect 1: A reference voltage generator, including: a first field effect transistor (FET) including a first threshold voltage; a second FET including a second threshold voltage different than the first threshold voltage; a gate voltage generator coupled to gates of the first and second FETs; a first current source coupled in series with the first FET between first and second voltage rails; a second current source; and a first resistor coupled in series with the second current source and the second FET between the first and second voltage rails, wherein a reference voltage is generated across the first resistor.

Aspect 2: The reference voltage generator of aspect 1, wherein the gate voltage generator includes: a first input coupled to a first node between the first current source and the first FET; a second input coupled to a second node between the second current source and the second FET; and an output coupled to the gates of the first and second FETs.

Aspect 3: The reference voltage generator of aspect 1, wherein the gate voltage generator includes an operational amplifier including: a first input coupled to a first node between the first current source and the first FET; a second input coupled to a second node between the second current source and the second FET; and an output coupled to the gates of the first and second FETs.

Aspect 4: The reference voltage generator of aspect 2 or 3, further including a second resistor coupled between the first node and the first FET.

Aspect 5: The reference voltage generator of aspect 4, wherein the first and second resistors have substantially the same resistance.

Aspect 6: The reference voltage generator of any one of aspects 1-5, wherein the first and second current sources are coupled together to form a current mirror.

Aspect 7: The reference voltage generator of aspect 6, wherein a current ratio of the current mirror is M over N, wherein M is different than N.

Aspect 8: The reference voltage generator of aspect 6, wherein a current ratio of the current mirror is substantially one-to-one.

Aspect 9: The reference voltage generator of any one of aspects 1-8, wherein the first and second current sources include third and fourth FETs, respectively.

Aspect 10: The reference voltage generator of aspect 9, wherein gates of the third and fourth FETs are coupled together, and to a drain of the third FET.

Aspect 11: The reference voltage generator of aspect 9, wherein the first and second FETs are each an n-channel metal oxide semiconductor (NMOS) FET, and wherein the third and fourth FETs are each a p-channel metal oxide semiconductor (PMOS) FET.

Aspect 12: The reference voltage generator of aspect 9, wherein the first and second FETs are each a p-channel metal oxide semiconductor (PMOS) FET, and wherein the third and fourth FETs are each an n-channel metal oxide semiconductor (NMOS) FET.

Aspect 13: The reference voltage generator of any one of aspects 1-12, wherein the gate voltage generator is configured to provide a gate voltage to the first and second FETs to operate the first and second FETs in sub-threshold region.

Aspect 14: The reference voltage generator of any one of aspects 1-13, wherein the first threshold voltage is greater than the second threshold voltage.

Aspect 15: A method of generating a reference voltage, including: generating a first current through a first field effect transistor (FET) including a first threshold voltage; generating a second current through a second FET including a second threshold voltage different than the first threshold voltage; and routing the second current through a first resistor to generate the reference voltage across the first resistor.

Aspect 16: The method of aspect 15, wherein the second threshold voltage is greater than the first threshold voltage.

Aspect 17: The method of aspect 15 or 16, wherein the first current is substantially equal to the second current.

Aspect 18: The method of aspect 15 or 16, wherein the first current is different than the second current.

Aspect 19: The method of any one of aspects 15-18, further including: biasing the first FET with a first drain-to-source voltage; and biasing the second FET with a second drain-to-source voltage, wherein the first drain-to-source voltage is substantially equal to the second drain-to-source voltage.

Aspect 20: The method of any one of aspects 15-19, wherein the reference voltage is substantially temperature independent over a temperature range of around −40 degrees Celsius to 120 degrees Celsius.

Aspect 21: An apparatus for generating a reference voltage, including: means for generating a first current through a first field effect transistor (FET) including a first threshold voltage; means for generating a second current through a second FET including a second threshold voltage different than the first threshold voltage; and means for routing the second current through a first resistor to generate the reference voltage across the first resistor.

Aspect 22: The apparatus of aspect 21, wherein the second threshold voltage is greater than the first threshold voltage.

Aspect 23: The apparatus of aspect 21 or 22, wherein the first current is substantially equal to the second current.

Aspect 24: The apparatus of aspect 21 or 22, wherein the first current is different than the second current.

Aspect 25: The apparatus of any one of aspects 21-24, further including: means for biasing the first FET with a first drain-to-source voltage; and means for biasing the second FET with a second drain-to-source voltage, wherein the first drain-to-source voltage is substantially equal to the second drain-to-source voltage.

Aspect 26: A wireless communication device, including: one or more signal processing cores; at least one antenna; and a transceiver coupled to the one or more signal processing cores and to the at least one antenna, wherein the transceiver includes a reference voltage generator, including: a first field effect transistor (FET) including a first threshold voltage; a second FET including a second threshold voltage different than the first threshold voltage; a gate voltage generator coupled to gates of the first and second FETs; a first current source coupled in series with the first FET between first and second voltage rails; a second current source; and a first resistor coupled in series with the second current source and the second FET between the first and second voltage rails, wherein a reference voltage is generated across the first resistor.

Aspect 27: The wireless communication device of aspect 26, wherein the gate voltage generator includes an operational amplifier including: a first input coupled to a first node between the first current source and the first FET; a second input coupled to a second node between the second current source and the second FET; and an output coupled to the gates of the first and second FETs.

Aspect 28: The wireless communication device of aspect 27, further including a second resistor coupled between the first node and the first FET.

Aspect 29: The wireless communication device of aspect 27 or 28, wherein the first and second current sources are coupled together to form a current mirror.

Aspect 30: The wireless communication device of aspect 29, wherein a current ratio of the current mirror is substantially one-to-one.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

What is claimed:

1. A reference voltage generator, comprising:

a first field effect transistor (FET) including a first threshold voltage;

a second FET including a second threshold voltage different than the first threshold voltage;

a gate voltage generator coupled to gates of the first and second FETs;

a first current source coupled in series with the first FET between a first voltage rail and a second voltage rail;

a second current source, wherein the gate voltage generator comprises an operational amplifier including:

a first input coupled to a first node between the first current source and the first FET;

a second input coupled to a second node between the second current source and the second FET; and an output coupled to the gates of the first and second FETs;

a first resistor coupled in series with the second current source and the second FET between the first and second voltage rails, wherein a reference voltage is generated across the first resistor; and a second resistor coupled between the first node and the first FET.

2. The reference voltage generator of claim 1, wherein the first and second resistors have substantially the same resistance.

3. The reference voltage generator of claim 1, wherein the first and second current sources are coupled together to form a current mirror.

4. The reference voltage generator of claim 3, wherein a current ratio of the current mirror is M over N, wherein M is different than N.

5. The reference voltage generator of claim 3, wherein a current ratio of the current mirror is substantially one-to-one.

6. The reference voltage generator of claim 1, wherein the gate voltage generator is configured to provide a gate voltage to the first and second FETs to operate the first and second FETs in sub-threshold region.

7. The reference voltage generator of claim 1, wherein the first threshold voltage is greater than the second threshold voltage.

8. A reference voltage generator, comprising:

a first field effect transistor (FET) including a first threshold voltage;

a second FET including a second threshold voltage different than the first threshold voltage;

a gate voltage generator coupled to gates of the first and second FETs;

a first current source coupled in series with the first FET between a first voltage rail and a second voltage rail;

a second current source, wherein the first and second current sources comprise third and fourth FETs, respectively, and wherein gates of the third and fourth FETs are coupled together, and to a drain of the third FET; and a first resistor coupled in series with the second current source and the second FET between the first and second voltage rails, wherein a reference voltage is generated across the first resistor.

9. The reference voltage generator of claim 8, wherein the first and second FETs are each an n-channel metal oxide semiconductor (NMOS) FET, and wherein the third and fourth FETs are each a p-channel metal oxide semiconductor (PMOS) FET.

10. A reference voltage generator, comprising:

a first field effect transistor (FET) including a first threshold voltage;

a second FET including a second threshold voltage different than the first threshold voltage;

a gate voltage generator coupled to gates of the first and second FETs;

a first current source coupled in series with the first FET between a first voltage rail and a second voltage rail;

a second current source, wherein the first and second current sources comprise third and fourth FETs, respectively, wherein the first and second FETs are each a p-channel metal oxide semiconductor (PMOS) FET, and wherein the third and fourth FETs are each an n-channel metal oxide semiconductor (NMOS) FET; and a first resistor coupled in series with the second current source and the second FET between the first and second voltage rails, wherein a reference voltage is generated across the first resistor.

11. A method of generating a reference voltage, comprising:

generating a first current through a first field effect transistor (FET) including a first threshold voltage;

generating a second current through a second FET including a second threshold voltage different than the first threshold voltage; and routing the second current through a first resistor to generate the reference voltage across the first resistor, wherein the reference voltage is substantially temperature independent over a temperature range of around −40 degrees Celsius to 120 degrees Celsius.

12. The method of claim 11, wherein the second threshold voltage is greater than the first threshold voltage.

13. The method of claim 11, wherein the first current is substantially equal to the second current.

14. The method of claim 11, wherein the first current is different than the second current.

15. The method of claim 11, further comprising:

biasing the first FET with a first drain-to-source voltage; and biasing the second FET with a second drain-to-source voltage, wherein the first drain-to-source voltage is substantially equal to the second drain-to-source voltage.

16. An apparatus for generating a reference voltage, comprising:

means for generating a first current through a first field effect transistor (FET) including a first threshold voltage;

means for generating a second current through a second FET including a second threshold voltage different than the first threshold voltage; and means for routing the second current through a first resistor to generate the reference voltage across the first resistor, wherein the reference voltage is substantially temperature independent over a temperature range of around −40 degrees Celsius to 120 degrees Celsius.

17. The apparatus of claim 16, wherein the second threshold voltage is greater than the first threshold voltage.

18. The apparatus of claim 16, wherein the first current is substantially equal to the second current.

19. The apparatus of claim 16, wherein the first current is different than the second current.

20. The apparatus of claim 16, further comprising:

means for biasing the first FET with a first drain-to-source voltage; and means for biasing the second FET with a second drain-to-source voltage, wherein the first drain-to-source voltage is substantially equal to the second drain-to-source voltage.

21. A wireless communication device, comprising:

one or more signal processing cores;

at least one antenna; and a transceiver coupled to the one or more signal processing cores and to the at least one antenna, wherein the transceiver includes a reference voltage generator, comprising:

a first field effect transistor (FET) including a first threshold voltage;

a second FET including a second threshold voltage different than the first threshold voltage;

a gate voltage generator coupled to gates of the first and second FETs;

a first current source coupled in series with the first FET between a first voltage rail and a second voltage rail;

a second current source; and a first resistor coupled in series with the second current source and the second FET between the first and second voltage rails, wherein a reference voltage is generated across the first resistor.

22. The wireless communication device of claim 21, wherein the gate voltage generator comprises an operational amplifier including:

a first input coupled to a first node between the first current source and the first FET;

a second input coupled to a second node between the second current source and the second FET; and an output coupled to the gates of the first and second FETs.

23. The wireless communication device of claim 22, further comprising a second resistor coupled between the first node and the first FET.

24. The wireless communication device of claim 22, wherein the first and second current sources are coupled together to form a current mirror.

25. The wireless communication device of claim 24, wherein a current ratio of the current mirror is substantially one-to-one.

* * * * *